United States Patent [19]

Bock

[11] Patent Number: 4,751,950

[45] Date of Patent: Jun. 21, 1988

[54] CAMERA AND LENS PROTECTOR

[76] Inventor: John S. Bock, 709 Jewel, Topeka, Kans. 66606

[21] Appl. No.: 6,451

[22] Filed: Jan. 21, 1987

[51] Int. Cl.[4] ..... A45G 11/38

[52] U.S. Cl. ..... 150/52 J; 206/316

[58] Field of Search ..... 150/52 J; 206/316

[56] References Cited

U.S. PATENT DOCUMENTS

| | | |
|---|---|---|
| 1,535,312 | 4/1925 | Hosking . |
| 2,482,248 | 9/1949 | Coon . |
| 2,537,303 | 1/1951 | Cobb, Jr. et al. . |
| 3,036,506 | 5/1962 | Andresen, Jr. . |
| 3,528,720 | 9/1970 | Treace . |
| 4,000,769 | 1/1977 | Katz . |
| 4,033,392 | 4/1977 | Less . |
| 4,071,066 | 1/1978 | Schaeffer . |
| 4,136,726 | 1/1979 | Lee . |
| 4,155,453 | 5/1979 | Ono . |
| 4,176,701 | 12/1979 | Welgan . |
| 4,260,004 | 4/1981 | Domke . |
| 4,266,663 | 5/1981 | Geraci . |
| 4,421,150 | 12/1983 | Masters . |
| 4,549,589 | 10/1985 | Nguyen . |
| 4,620,396 | 11/1986 | Bjorntwedt . |

FOREIGN PATENT DOCUMENTS

| | | |
|---|---|---|
| 2061691 | 6/1972 | Fed. Rep. of Germany ..... 150/52 J |

*Primary Examiner*—William Price

*Attorney, Agent, or Firm*—Hovey, Williams, Timmons & Collins

[57] ABSTRACT

An improved cover for protecting professional quality camera equipment from the effects of weather is provided which permits full access to the camera and lens and does not interfere with rapid, critical focusing and shooting. The cover is formed of flexible moisture resistant sheet material and includes an apertured rear wall along with forwardly extending top and sidewalls designed to cover essentially the entire length of the protected equipment. The rear wall aperture is preferably maintained in registry with the camera viewfinder while the forward end of the cover is releasably attached to the lens leaving the forward optical face of the lens exposed; in this way the optics of the camera equipment are in no way impaired and the user can accurately focus and easily manipulate the equipment. A lower access opening to the equipment is provided between the cover sidewalls, allowing the user to rotate the lens barrel for focusing purposes and to otherwise normally operate the equipment. Preferably, the cover also has an under flap extending from one sidewall and releasably attachable to the rear wall which provides further weather protection.

8 Claims, 2 Drawing Sheets

CAMERA AND LENS PROTECTOR

BACKGROUND OF THE INVENTION

1. Field of the Invention

The present invention is concerned with an improved protective cover particularly designed for use in connection with sophisticated, professional quality camera equipment, typically of the type making use of an elongated telephoto lens. More particularly, it is concerned with such a protective cover which does not detract in any way from the optical qualities of the camera or inhibit fast, accurate focusing or other equipment manipulations, all while giving complete protection against the effects of bad weather.

2. Description of the Prior Art

Professional photographers employed by newspapers or magazines often make use of very expensive camera equipment which is far more sophisticated than the simple cameras used by laymen. To give but one example, when photographing athletic events such as football games, such professionals would normally use a tripod or monopod-mounted assembly in the form of a camera body equipped with a motor drive, together with an elongated telephoto lens. The latter would normally include an axially rotatable focusing barrel and, in many instances, a forwardly extending, stationary tubular lens hood.

It also sometimes happens that equipment of the type described above must be used during periods of rain or other inclement weather. This presents a real difficulty for the professional photographer, inasmuch as his expensive equipment can be damaged if exposed to such weather. As a consequence, it has been known in the past for photographers to attempt to alleviate this problem through the use of crude, makeshift expedients, e.g., placing the camera equipment at least partially within a plastic bag or the like. These attempts have met with little success, however, because they inevitably involve covering the camera equipment to the extent of inhibiting use thereof, or conversely providing insufficient weather protection.

It has also been known in the past to provide various types of camera cases and covers for specialized purposes. For example, U.S. Pat. No. 4,033,392 describes a weather proofing device for cameras in the form of a flexible and transparent bag. While such a device does provide a measure of weather protection, it is deficient inasmuch as the optics of the camera equipment are inevitably affected. That is to say, the user must look through the plastic bag to use the view finder, and this would make it difficult to accurately focus the lens. By the same token, images to be photographed can be distorted inasmuch as all light must first pass through the bag before entering the lens. These considerations take on special significance in the case of a professional photographer, whose livelihood depends upon the taking of sharp, accurate photographs.

There is therefore a decided need in the art for an improved cover for large camera equipment which does not in any way detract from the optical qualities of the equipment and permits the user to accurately and easily operate the equipment without undue hindrance.

SUMMARY OF THE INVENTION

The present invention overcomes the problems described above and provides a greatly improved cover for protecting a camera body and associated lens from the effects of inclement weather. Broadly speaking, the cover of the invention is in the form of a sheet of flexible, moisture-resistant material presenting a rear wall, a top wall, and a pair of elongated sidewalls extending forwardly from the rear wall and depending from the top wall. The top, rear and sidewalls cooperatively define an elongated recess for receiving and covering a camera body and lens. In particular, the cover is designed so that the rear wall thereof is positioned adjacent the back wall of the camera body, and with the top and sidewalls of the cover extending forwardly to cover the corresponding top and sides of the camera body and lens. Very importantly, the cover is configured so that the forward optical face of the lens is exposed, with a lower access opening being provided between the cover sidewalls to permit a user's hand to enter the recess in order to grip and manipulate portions of the lens and/or camera body.

In order to secure the cover in place, means such as mating Velcro strips are employed to secure the forward edge of the cover to the outer periphery of the lens assembly adjacent the optical face thereof. Moreover, means is provided for permitting viewing of the viewfinder through the rear wall of the cover. In practice, the rear wall is apertured and use is made of a threaded view finder ring forming a part of many professional quality viewfinders in order to secure the rear wall aperture in registry with the viewfinder.

In preferred forms of the invention, an underflap is also provided which extends from the lower margin of one sidewall and is adapted for releasable connection to the rear wall of the cover. The underwall thus provides further weather protection but still allows access to the camera equipment and permits the camera to be readily shifted between horizontal and vertical positions without loss of protection.

DESCRIPTION OF THE PREFERRED EMBODIMENTS

Figure 1:
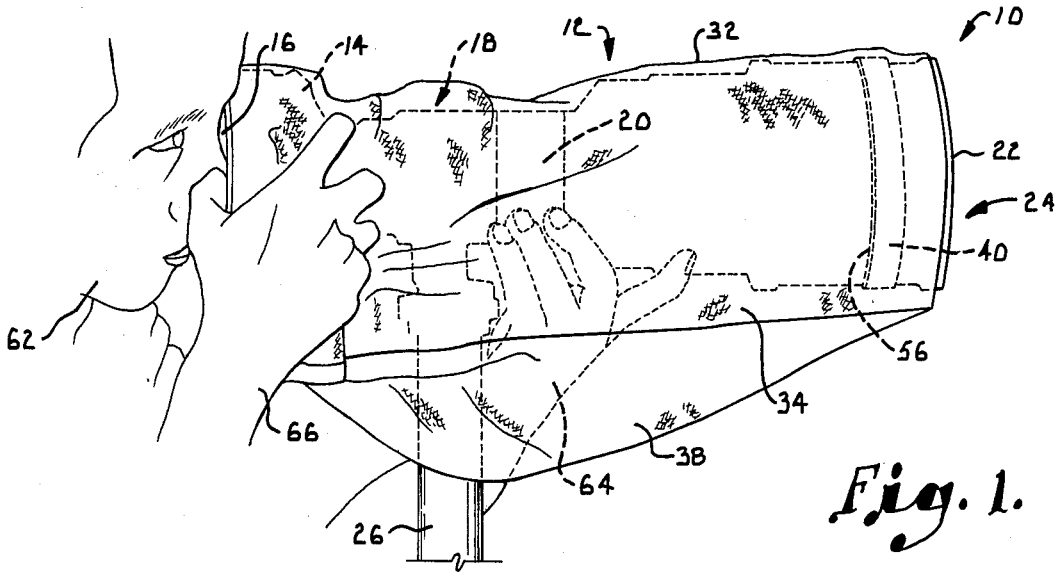
FIG. 1 is a side elevational view of the cover of the present invention, shown in protective disposition over a camera body and telephoto lens assembly, and with a user manipulating the lens.
Figure 2:
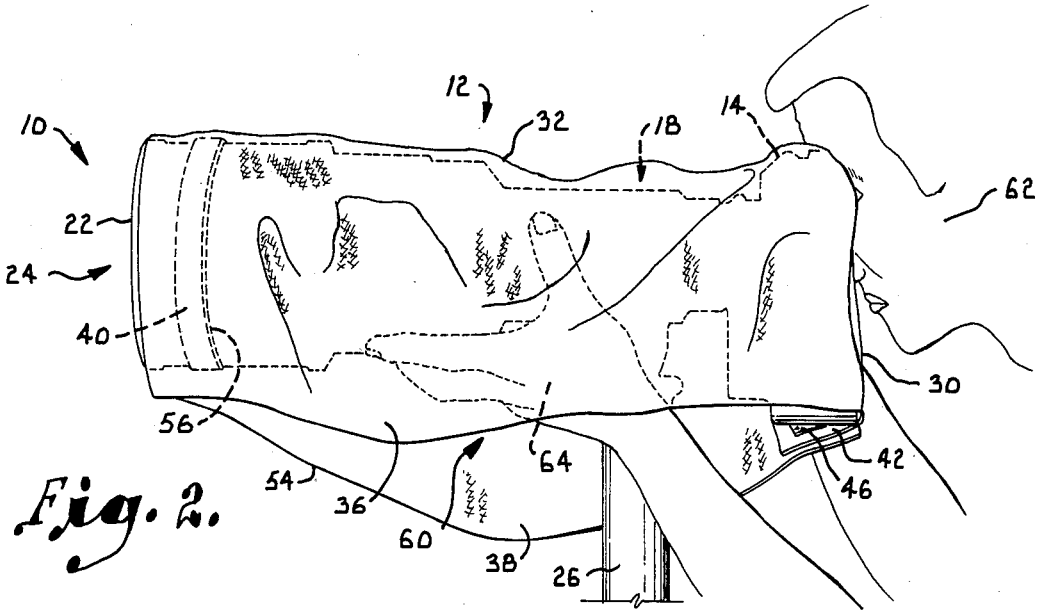
FIG. 2 is a view similar to that of FIG. 1, but showing the side of the cover and protected camera equipment opposite that illustrated in FIG. 1.

Turning now to FIGS. 1 and 2, professional camera equipment broadly referred to by the numeral 10 is illustrated in phantom and protected by the cover 12 of the present invention. In the illustrated embodiment, the camera equipment 10 includes a camera body 14 having a rearmost viewfinder 16, together with an elongated, forwardly extending telephoto lens 18 coupled to camera body 14. The lens 18 is conventional and includes a rotatable focusing ring or barrel 20 and a forwardmost tubular lens hood 22. As those skilled in the art will readily appreciate, hood 22 is normally stationary and protects the forward optical face 24 of the lens 18. Finally, a conventional tripod 26 is secured to and depends from the underside of equipment 10 in order to rigidly support the latter.

Figure 5:
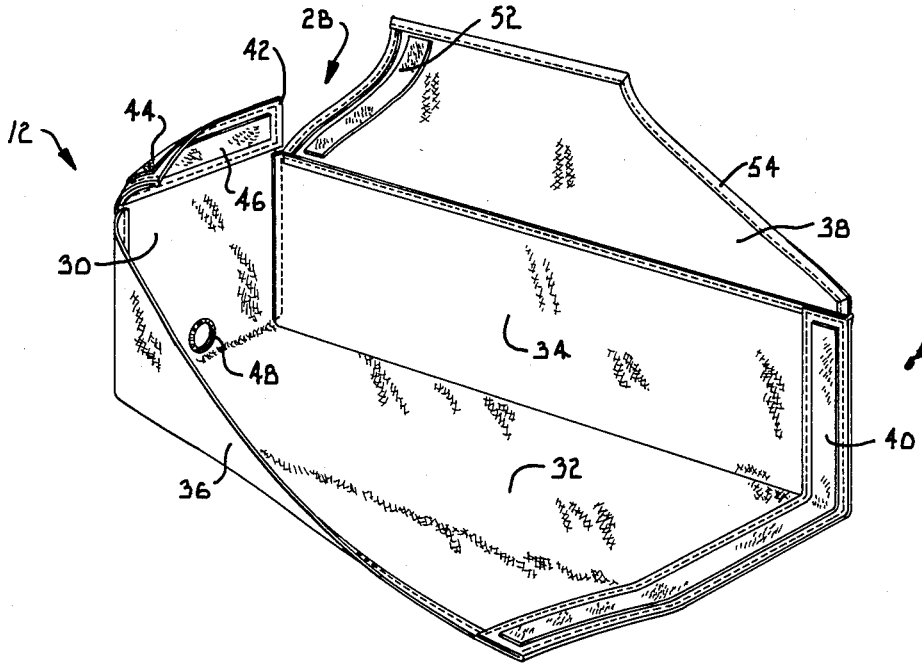
FIG. 5 is a perspective view illustrating the underside of the cover of the invention, shown in an opened condition to illustrate the details of construction of the cover.

Turning now to FIG. 5, it will be seen that cover 12 is in the form of a specially configured sheet 28 of moisture resistant material (e.g., woven nylon or plastic). In the embodiment shown, certain sections of the sheet are stitched to form seams, but it will of course be appreciated that the cover could be formed integrally as well. In any event, it will be seen that the sheet 28 presents a rear wall 30 together with a top wall 32 and a pair of sidewalls 34, 36. Walls 32–36 extend forwardly from rear wall 30, with the sidewalls 34, 36 depending from top wall 32. It will also be observed that the sheet 28 includes an underflap 38 extending from the lower edge of sidewall 34, and that the forwardmost inner surface of the walls 32–36 is provided with a Velcro strip 40, the significance of which will be explained hereinafter.

Figure 4:
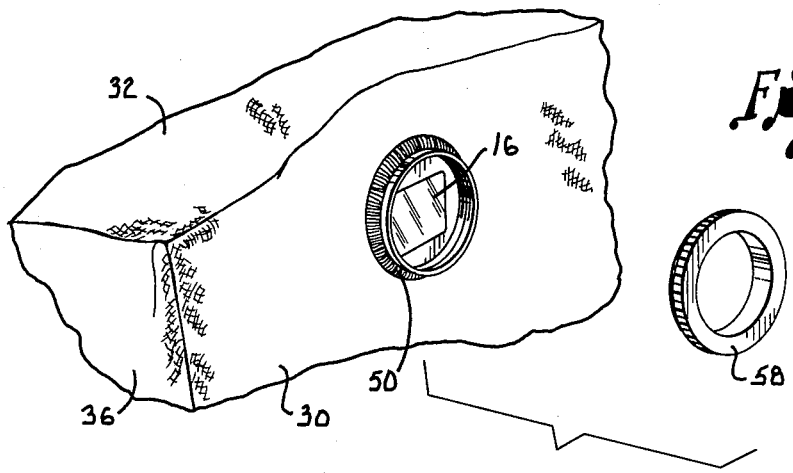
FIG. 4 is an enlarged, fragmentary, exploded view illustrating the preferred manner of connection of the rear wall of the cover to the back wall of the camera body using the camera body viewfinder ring.

In preferred forms, the rear wall 30 is provided with a depending, rectangular, laterally extending connection strip 42. Both the inner and outer faces of this strip 42 are provided with Velcro strips 44, 46. Moreover, the rear wall 30 is provided an aperture 48 therethrough which is advantageously reinforced by circumscribing stitching 50 (see FIG. 4).

The rearmost vertical margin of underflap 38 is also provided with a Velcro strip 52, and it is important for purposes of the invention that the strips 44, 52 be designed for mating interconnection. Finally, it will be seen that the flap 38 has an obliquely extending forward edge 54 running from the horizontal bottom margin of the flap to the lower edge of sidewall 34.

In order to affix cover 12 to the camera equipment 10, it is first of all necessary to apply a pair of Velcro strips to the equipment itself. Specifically, a Velcro strip 56 is applied to the lens adjacent the forwardmost end thereof (in this case to the hood 22) in disposition to mate with the Velcro strip 40 provided on cover 12. Similarly, another Velcro strip (not shown) is affixed to the underside of camera body 14 (which may comprise a motor drive) and is likewise adapted to mate with the strip 46 attached to the inner surface of connection strip 42. The only other preliminary step involves removal of the rotatable metallic viewfinder ring 58 provided with cameras of this type (see FIG. 4).

At this point the cover is attached by first placing aperture 48 in registry with the viewfinder 16. As viewed in FIG. 4, this involves placing the reinforcing stitching 50 about the rearwardly projecting lip of the viewfinder structure. The ring 58 is then threaded onto such projecting structure, in order to affix the rear wall 30 of the cover to the back wall of the camera body. Next, the connection strip 42 is folded upwardly so as to intercouple the Velcro strip 46 with that applied to the underside of the camera body. The application of the cover 12 is completed by connecting the mating Velcro strips 40, 56 respectively provided on the inner surface of the cover and lens, followed by a similar interconnection of the Velcro strip 44, 52.

Figure 3:
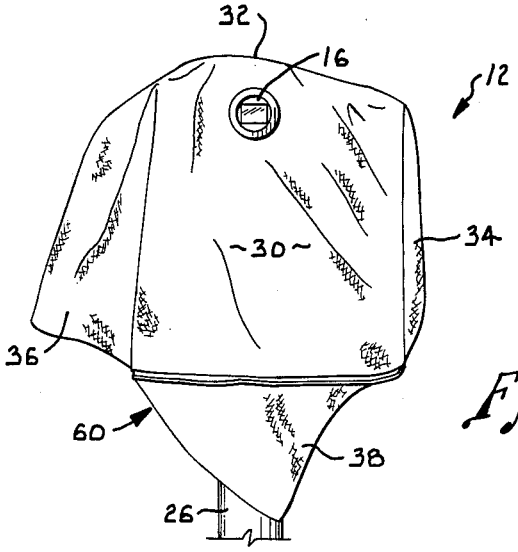
FIG. 3 is a rear end elevational view of the cover and protected camera equipment depicted in FIGS. 1 and 2, and illustrating the way in which the cover provides unobstructed viewing of the viewfinder.

Upon such installation of the cover 12, it will be seen that the top wall, rear wall and sidewalls of the cover cooperatively define an elongated recess receiving the camera equipment 12. Moreover, an access opening 60 is provided between the sidewalls 34, 36 and such access opening 60 is located between the lower margin of wall 36 and the lower defining edges of the underflap 38 (see FIG. 3). As illustrated, the flap engages the upright standard of tripod 26 and in effect wraps around this standard to provide further weather protection.

Returning now to FIGS. 1 and 2, a photographer 62 is shown using equipment 10 with the cover 12 in place. Specifically, the photographer 62 is shown with his eye adjacent viewfinder 16 and with one hand 64 within the equipment recess presented by the cover. In particular, the photographer's hand 64 is grasping the rotatable focusing ring 20, so as to properly focus the camera equipment for shooting. The other hand 66 of photographer 62 grasps the camera body 14 through the cover 12 for shooting purposes. The flexibility of the material making up the sheet 28 permits actuation of the shutter button through the cover. Thus the photographer can readily focus the equipment and take his photographs without impairment. It is particularly noteworthy that the cover 12 does not in any way interfere with the optics of the camera equipment, i.e., both the viewfinder 16 and the optical face 24 of the lens remain unobstructed and exposed.

Virtually all other camera operations can be quickly and easily performed with cover 12 in place. Thus, if the photographer desires to rotate body 14 from a horizontal to a vertical position, such is done in the usual fashion; the sheet 38 is advantageously provided with enough excess fabric to permit such rotation without requiring the cover to be taken off or in any way altered. Similarly, when it is desired to rewind and/or change film in the camera body 14, it is only necessary to temporarily disconnect the Velcro strips 44, 52 and to likewise disconnect strip 46 from its associated mate, whereupon the rear wall 30 of the cover can be lifted to provide needed access. There is no danger of completely dislodging the cover 12, however, inasmuch as it is still retained in place by means of the ring 58 as explained.

Figure 6:
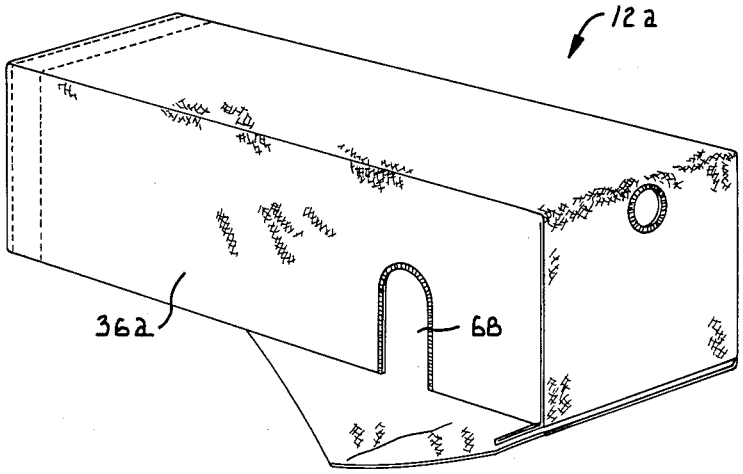
FIG. 6 is a perspective view of the outside of another cover in accordance with the invention, provided with a slot in one sidewall thereof to accommodate certain types of camera equipment.

The cover 12 depicted in FIGS. 1–5 is particularly designed for use with present day professional quality Canon equipment. Some professional photographers prefer Nikon equipment, however, and for this purpose a very similar cover **12*a* is provided (see FIG. 6). The cover 12*a* is in most respects identical to the first-described cover, and therefore need not be described in detail. However, the Nikon equipment used by professional photographers includes a tripod arrangement which can present difficulties if the cover first described is employed. Accordingly, in the Nikon cover 12*a*, the sidewall 36*a* is provided with an upwardly extending slot or recess 68 therein so that upon rotation of the camera body between a horizontal and a vertical position, the slot 68 accommodates the Nikon tripod arrangement and permits ready camera manipulations in the manner described. Apart from the described slot and minor dimensional differences in the respective cover walls, the covers 12 and 12*a*** are essentially identical.

I claim:

1. A cover for protecting a camera and associated lens from the effect of inclement weather while permitting normal operative manipulation of the body and lens, said camera body including a back wall having a viewfinder therethrough and a bottom wall, said lens being coupled with said body and having a forwardmost optical face, said cover comprising:

a sheet of flexible, moisture-resistant material presenting a rear wall, a top wall and a pair of elongated sidewalls extending forwardly from said rear wall and depending from said top wall, said top wall, rear wall and sidewalls cooperatively defining an elongated recess for receiving and covering said camera body and lens with said camera body back wall adjacent said rear wall, and with said top wall and sidewalls covering the top and sides of said camera body and lens while leaving said optical face exposed and presenting between said sidewalls an access opening for permitting a user's hand to enter said recess to grip and manipulate portions of said lens, the inner surfaces of said top and sidewalls adjacent the forward ends thereof proximal to said optical face defining a lens-engaging margin;

means for releasably securing said lens-engaging margin to the outer periphery of said lens adjacent said optical face;

means for permitting viewing of said viewfinder through said rear wall; and releasable connection means for coupling said sheet to said body, said connection means being disposed adjacent said rear wall of said sheet and being independent of said releasable securing means, said sheet being of dimensions sufficient for enabling lifting movement of said rear wall of said sheet away from said camera body upon release of said connection means for substantial exposure of said camera body while said securing means retains said lens-engaging margin in securement with said lens.

2. A cover for protecting a camera and associated lens from the effect of inclement weather while permitting normal operative manipulation of the body and lens, said camera body including a back wall having a viewfinder therethrough and a bottom wall, said lens being coupled with said body and having a forwardmost optical face, said cover comprising:

a sheet of flexible, moisture-resistant material presenting a rear wall, a top wall and a pair of elongated sidewalls extending forwardly from said rear wall and depending from said top wall, said top wall, rear wall and sidewalls cooperatively defining an elongated recess for receiving and covering said camera body and lens with said camera body back wall adjacent said rear wall, and with said top wall and sidewalls covering the top and sides of said camera body and lens while leaving said optical face exposed and presenting between said sidewalls an access opening for permitting a user's hand to enter said recess to grip and manipulate portions of said lens, the inner surfaces of said top and sidewalls adjacent the forward ends thereof proximal to said optical face defining a lens-engaging margin;

means for releasably securing said lens-engaging margin to the outer periphery of said lens adjacent said optical face; and means for permitting viewing of said viewfinder through said rear wall, said securing means comprising mating Velcro strips respectively affixed to said lens-engaging margin and adapted to be attached to said lens outer periphery.

3. A cover for protecting a camera and associated lens from the effect of inclement weather while permitting normal operative manipulation of the body and lens, said camera body including a back wall having a viewfinder therethrough and a bottom wall, said lens being coupled with said body and having a forwardmost optical face, said cover comprising:

a sheet of flexible, moisture-resistant material presenting a rear wall, a top wall and a pair of elongated sidewalls extending forwardly from said rear wall and depending from said top wall, said top wall, rear wall and sidewalls cooperatively defining an elongated recess for receiving and covering said camera body and lens with said camera body back wall adjacent said rear wall, and with said top wall and sidewalls covering the top and sides of said camera body and lens while leaving said optical face exposed and presenting between said sidewalls an access opening for permitting a user's hand to enter said recess to grip and manipulate portions of said lens, the inner surfaces of said top and sidewalls adjacent the forward ends thereof proximal to said optical face defining a lens-engaging margin;

means for releasably securing said lens-engaging margin to the outer periphery of said lens adjacent said optical face;

means for permitting viewing of said viewfinder through said rear wall; and an under flap extending from a lower edge of said cover, there being structure for releasably maintaining said under flap in partial closing relationship to the underside of said recess while leaving said access opening between said sidewalls.

4. The cover of claim 3, said under flap-maintaining structure comprising mating Velcro strips respectively coupled to the lower edge of said rear wall and said under flap.

5. The cover of claim 3, said under flap extending from the lower edge of one of said sidewalls.

6. The cover of claim 1; and including an under flap extending from a lower edge of said cover, there being structure for releasably maintaining said under flap in secure connection with said rear wall while leaving said access opening between said sidewalls.

7. A cover for protecting a camera and associated lens from the effect of inclement weather while permitting normal operative manipulation of the body and lens, said camera body including a back wall having a viewfinder therethrough and a bottom wall, said lens being coupled with said body and having a normally stationary hood and forwardmost optical face, said covering comprising:

a sheet of flexible, moisture-resistant material presenting a rear wall, a top wall and a pair of elongated sidewalls extending forwardly from said rear wall and depending from said top wall, said top wall, rear wall and sidewalls cooperatively defining an elongated recess for receiving and covering said camera body and lens with said camera body back wall adjacent said rear wall, and with said top wall and sidewalls covering the top and sides of said camera body and lens while leaving said optical face exposed and presenting between said sidewalls an access opening for permitting a user's hand to enter said recess to grip and manipulate portions of said lens, the inner surfaces of said top and sidewalls adjacent the forward ends thereof proximal to said optical face defining a lens-engaging margin;

means for releasably securing said lens-engaging margin to said normally stationary hood of said lens adjacent said optical face;

means for permitting viewing of said viewfinder through said rear wall; and means for releasably connecting said sheet to said body of said camera, said sheet including a quantity of excess material and presenting dimensions sufficient for enabling rotation of said camera body within said cover and relative to said hood in an arc of approximately ninety degrees without the need for releasing said lens-engaging margin from said hood.

8. A cover for protecting a camera and associated lens from the effect of inclement weather while permitting normal operative manipulation of the body and lens, said camera body including a back wall having a viewfinder therethrough and a bottom wall, said lens being coupled with said body and having a forwardmost optical face, said cover comprising:

a sheet of flexible, moisture-resistant material presenting a rear wall, a top wall and a pair of elongated sidewalls extending forwardly from said rear wall and depending from said top wall, said top wall, rear wall and sidewalls cooperatively defining an elongated recess for receiving and covering said camera body and lens with said camera body back wall adjacent said rear wall, and with said top wall and sidewalls covering the top and sides of said camera body and lens while leaving said optical face exposed and presenting between said sidewalls an access opening for permitting a user's hand to enter said recess to grip and manipulate portions of said lens, the inner surfaces of said top and sidewalls adjacent the forward ends thereof proximal to said optical face defining a lens-engaging margin;

means for releasably securing said lens-engaging margin to the outer periphery of said lens adjacent said optical face; and means for permitting viewing of said viewfinder through said rear wall, said view-permitting means comprising structure independent of said releasable securing means and of said lens-engaging margin, said structure defining an aperture through said rear wall and oriented for registration and said viewfinder, said aperture being generally complemental in configuration to said viewfinder and not substantially larger than the same, there being means for fixedly securing said aperture-defining structure to said camera with said aperture in registry with said viewfinder.

* * * * *